US005289650A

United States Patent [19]

Follett et al.

[11] Patent Number: 5,289,650

[45] Date of Patent: Mar. 1, 1994

[54] BOTTLE ADVERTISER

[75] Inventors: Brian Follett, North Vancouver; Richard Herron, White Rock; Wendy Dayton, North Vancouver; Pat Bussword, Bowen Island; Don Manders; James Farries, both of Calgary, all of Canada

[73] Assignee: Alberta Distillers Limited, Burnaby, Canada

[21] Appl. No.: 637,280

[22] Filed: Jan. 3, 1991

[51] Int. Cl.[5] ..... G09F 3/00

[52] U.S. Cl. ..... 40/310; 40/312; 206/499

[58] Field of Search ..... 40/310, 358, 312, 584, 40/538, 331, 333, 539; 206/199, 45.34, 499; 215/100 R; 229/1.5 R; 211/188, 194, 70.1, 73

[56] References Cited

U.S. PATENT DOCUMENTS

| | | | |
|---|---|---|---|
| 1,054,252 | 2/1913 | Stranders | 40/310 |
| 1,246,385 | 11/1917 | Bimeler | 40/358 |
| 1,473,313 | 11/1923 | Piatt . | |
| 1,536,445 | 5/1925 | Maupi . | |
| 1,577,374 | 3/1926 | Shelley | 40/310 |
| 1,860,547 | 5/1932 | Marsh | 40/310 |
| 1,999,011 | 4/1935 | Wasser . | |
| 2,105,027 | 1/1938 | Davis | 215/100 R |
| 2,132,236 | 10/1938 | Greene . | |
| 2,234,475 | 3/1941 | Hyndman | 40/310 |
| 2,293,769 | 10/1942 | Kirchner et al. . | |
| 2,318,434 | 5/1943 | Strauch | 40/538 X |
| 2,507,443 | 5/1950 | Hunt | 206/499 |
| 2,651,862 | 9/1953 | Fine | 40/584 X |
| 3,423,861 | 1/1969 | Forsyth . | |
| 3,831,300 | 8/1974 | Berkhouse . | |

FOREIGN PATENT DOCUMENTS

| | | | |
|---|---|---|---|
| 961421 | 5/1950 | France | 40/310 |

*Primary Examiner*—Brian K. Green

*Attorney, Agent, or Firm*—Shlesinger Arkwright & Garvey

[57] ABSTRACT

An advertising display device for mounting on a bottle or other similar container, which includes a box having at least three flat walls, an open bottom and an openable top surface, the top surface having a central opening for permitting the passage therethrough of a bottle cap and a bottom of said walls being shaped to provide at least three points for contacting a shoulder of said bottle.

7 Claims, 4 Drawing Sheets

BOTTLE ADVERTISER

BACKGROUND

The present invention relates to device for advertising on a bottle or other container.

Various types of advertising devices for placement on a bottle or other container are known. For example, U.S. Pat. No. 1,999,011 issued to Wasser discloses a four-sided truncated pyramidal-shaped advertisier adapter to be fitted around a bottle neck and held in place by the square upper opening engaging the neck of a bottle. The latter advertiser is made from a strip by folding the latter along fold lines and gluing the ends. The sides of the advertiser extend out beyond the body of the bottle and, therefore, do no permit packaging the bottles in larger boxes with the advertiser in place. Moreover, the unit is easily misaligned by slight jarring and can easily be bent, torn or distorted by accidental handling as there is not means of reinforcing the device so that it will maintain its shape despite such action.

U.S. Pat. No. 2,132,236 issued to Greene on Oct. 4, 1938 discloses an advertising hanger or display consisting of folded section of thin cardboard stock with a circular opening to permit passage therethrough of a bottle top and a clip portion for holding a booklet and another folded flat portion for displaying a message. The Greene advertiser is relatively fragile and has no means for reinforcing the structure to resist accidental bending or tearing.

U.S. Pat. No. 1,536,445 issued to Maupai on May 5, 1925 discloses a more rigid structure for fitting over a bottle neck having side-wing members interlocking with the body of the display. However, the display has only one surface and extends beyond the confines of the bottle.

U.S. Pat. No. 1,473,313 issued to Piatt on Nov. 6, 1923 discloses a bottle advertising display which has two advertising surfaces available that are suspended from a bottle neck engaging center portion. However, the display surfaces are attached to the central portion by twisted, relatively thin connecting regions that are susceptible to tearing. Moreover, the displays extend out from the confines of the body of the bottle, making stacking of the bottles in a box with the displays in place impractical.

Consequently, known advertisers have only a limited number of separate message bearing surfaces available, are usually fragile, cannot be packed in a box with several other containers with the advertiser mounted on the bottle or container or must be adjusted into position by the uncertain bending of the cardboard material from which the advertiser is generally made.

Accordingly, it is an object of the invention to provide an improved bottle advertiser. It is another object to provide an advertiser which has at least three separate surfaces available for advertising. It is yet another object of the invention to provide an advertiser which occupies relatively little space so that it can be shipped when installed on a bottle or other container. It is yet another object of the invention to provide an advertiser which is shaped to allow it to be stacked.

SUMMARY OF THE INVENTION

In accordance with the invention there is provided an advertising display device for mounting on a bottle or other similar container, which includes a box having at least three flat walls, an open bottom and a top surface.

The top surface has a central opening for permitting the passage therethrough of a bottle cap portion and a bottom of said walls being shaped to provide at least three points for contacting a shoulder of the bottle.

Preferably the top surface includes side wings extending down alongside the side walls of at least two side walls and means for holding the wings against the side walls.

The sides of the device may be angled to be wider at the bottom than at the top so that the devices may be stacked when in non-flat assembled form.

The box may have four flat walls.

Advantageously, the top surface is openable so that the device may be folded flat.

The top surface includes side wings extending down alongside two side walls of the box and a front flap joined along a top edge of a front wall and extending to the two side wings so as to hold them against the side walls.

The front flap may have a slot adjacent a top edge of the front wall and the top surface has a downwardly depending flap dimensioned to be insertable in the slot.

The top surface opening may have a plurality of spaced apart radial cuts therein extending from a perimeter of the opening towards associated edges of the top surface.

The walls may each have an arcuate bottom edge to facilitate their contacting points on the shoulder of a bottle of equal elevation.

BRIEF DESCRIPTION OF THE DRAWINGS

The novel features believed characteristic of the invention are set forth in the appended claims. The invention itself as well as other features and advantages thereof, will be best understood by reference to the detailed description which follows, read in unction with the accompanying drawings, wherein:

DETAILED DESCRIPTION WITH REFERENCE TO THE DRAWINGS

Figure 1:
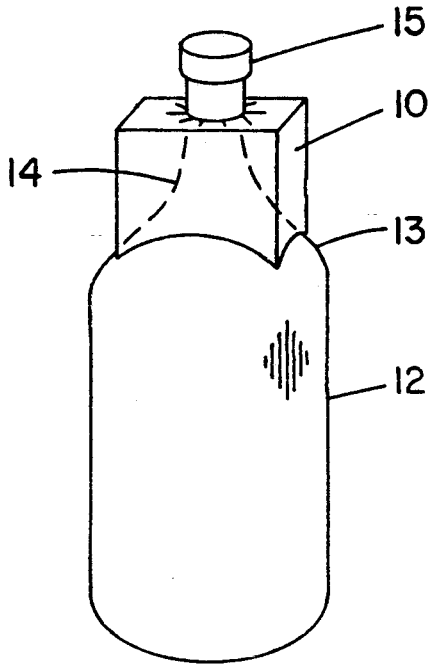
FIG. 1 is a perspective view of the bottle advertiser mounted over the neck of a bottle.

Referring to FIG. 1 the advertiser 10 is generally in the shape of a box open at the bottom and having four points 17 for contacting the shoulder 13 of a bottle 12. A top surface 18 has an opening 20 to permit the passage therethrough of a bottle cap 15.

Figure 2:
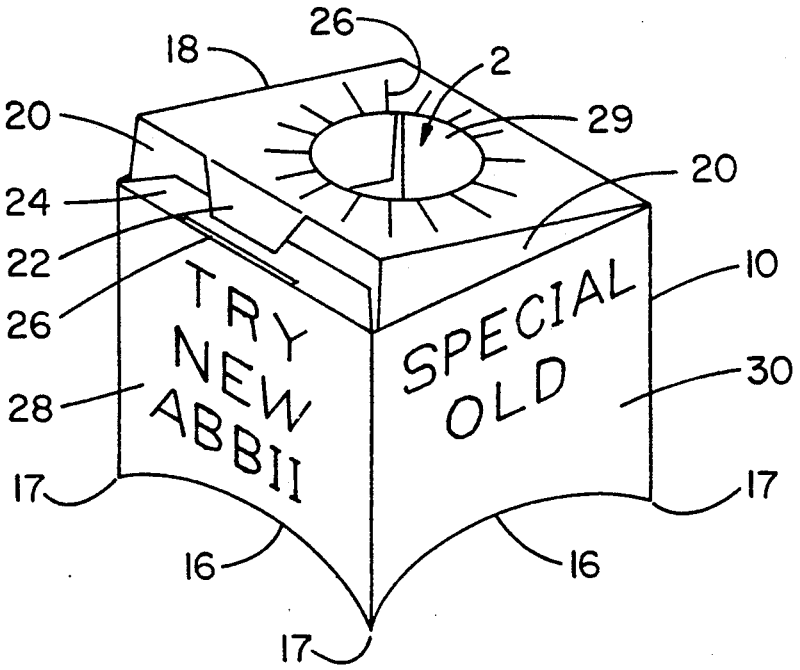
FIG. 2 is a perspective view showing the bottle advertiser construction.

Details of the construction are shown on FIG. 2 in which advertiser 10 has a front wall 28, side walls 30 and a rear wall 29. Each of the walls 28, 29, and 30 have arcuate bottom edges 16. A folding top surface 18 has two side wings 22 which slide along the inside of associated ones of the two sides 30 and a front flap 22 dimensioned to pass into a slot 26 between a front wing 24 and the front side 28 to which the front wing 24 is joined. A circular opening 20 formed centrally of top 18 has a plurality of radially spaced apart cuts 26 to permit the opening to be expanded in the event the bottle cap 15 is larger than the opening.

An installed advertiser as shown in FIG. 1 has four separate point of sale display surfaces 28, 29, 30 and 31. Moreover, the structure of advertiser 10 is very stable against deformation considering the interlocking front flap 22 insertable into slot 26 and the wings 20 held in place against respective sides 30 by the ends of wing 24. Moreover, the advertiser 10 is very compact and dimensioned to fit within the confines of bottle 12 so that the advertiser may be installed at the bottling plant and then shipped together with the bottles.

Figure 3:
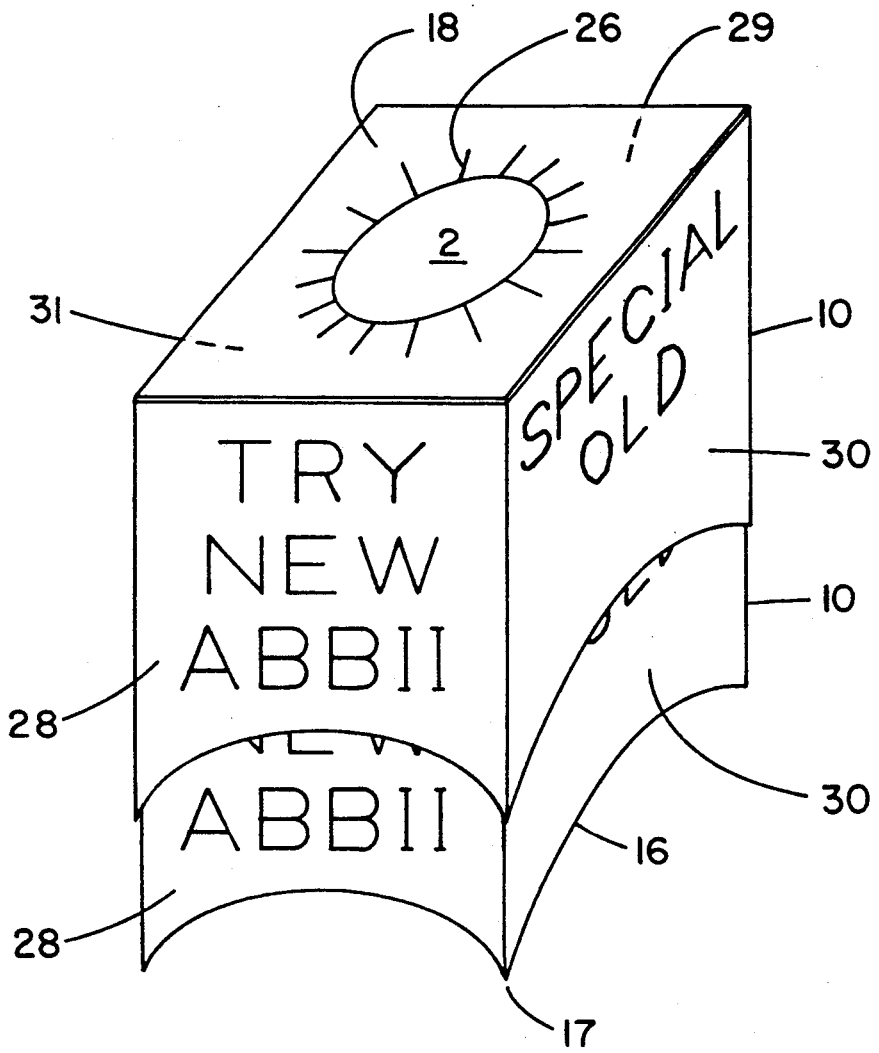
FIG. 3 is a perspective view showing two bottle advertisers stacked.

Referring to FIG. 3 there is shown a pair of advertisers as in FIGS. 1 and 2 stacked together. Such stacking capability is provided by angling the sides 28, 29, 30 and 31 so that they are wider at the bottom than at the top.

Figure 4:
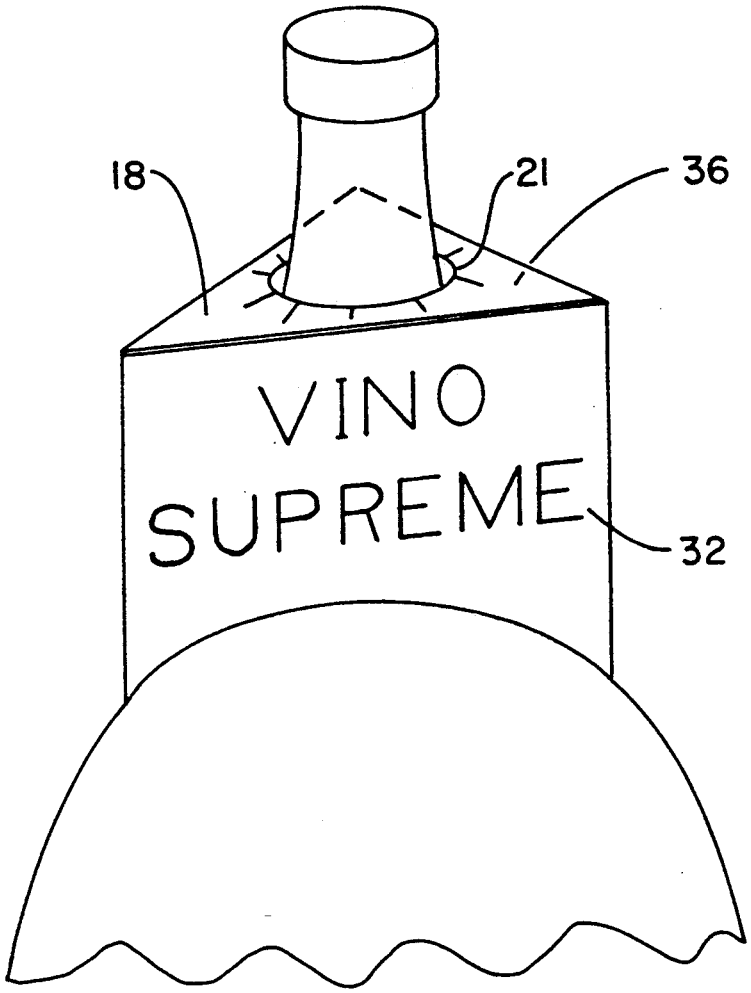
FIG. 4 is a perspective view of a three sided advertiser on a bottle.
Figure 5:
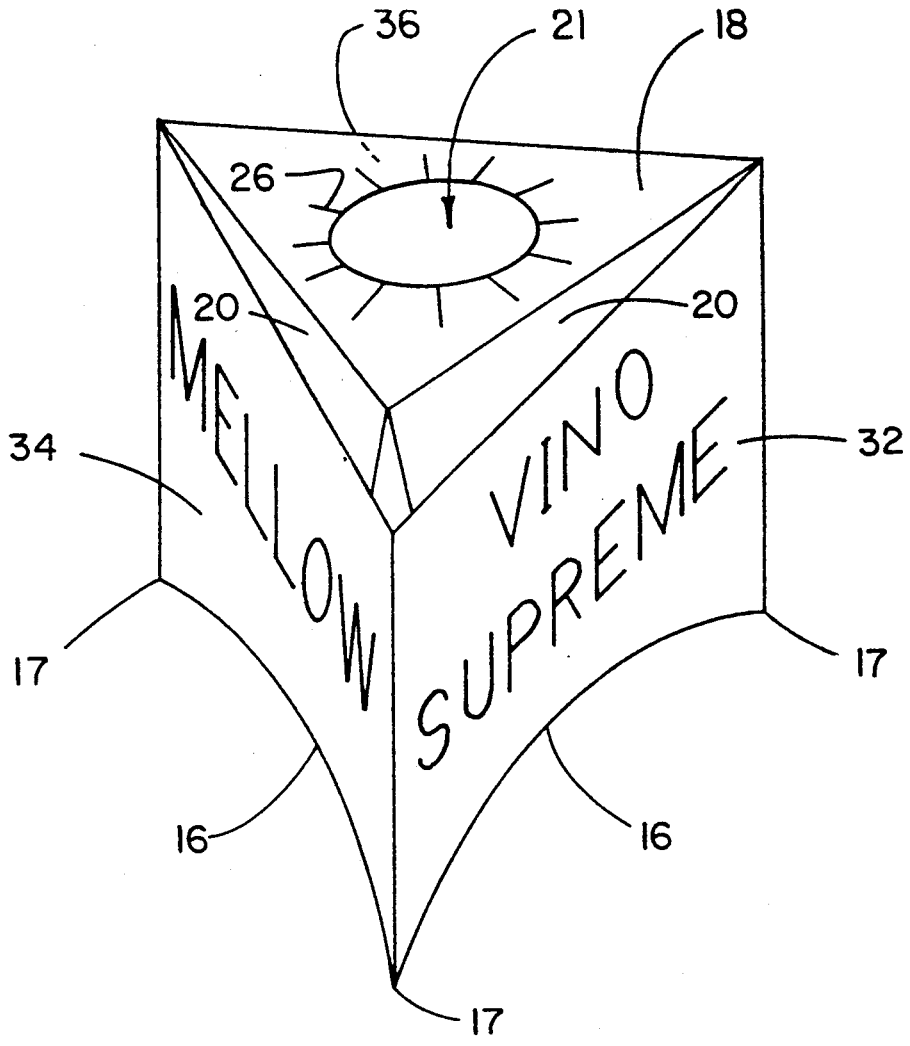
FIG. 5 a perspective view of the advertiser of FIG. 4 with the top surface partially opened.

Referring to FIG. 4 there is shown an alternative embodiment of the invention consisting of a three-sided advertiser 36 with display surfaces 32, 33, and 34. Top surfaces 35 has opening 38 with slits 40 which allow it to be enlarged and flaps 42 juxtaposed to sides 32 and 34 when the top surface 35 is closed. The bottom of the advertiser 36 has three arcuate bottom edges terminating in three points 47. FIG. 5 shows the advertiser 36 mounted on the neck of a bottle 49.

Clearly other equivalent advertisers can be easily appreciated such as one having five or more sides. However, a four sided advertiser is a preferred configuration given that it folds flat without having to bend any display surfaces and each surface is orthogonal to adjacent surfaces so that only one display surface is visible at a time if viewed normally to that surface.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

I claim:

1. An advertising display device for mounting on a bottle of a type having a top, neck, shoulder and body, comprising:

a tube having at least three flat side surfaces, open at a bottom, and having a closed top surface integral with at least one of said side surfaces, said top surface having a central opening for permitting the passage therethrough of the bottle top and neck and a bottom of said surfaces being shaped to provide at least three points for contacting the shoulder of said bottle, each of said side surfaces being wider across a bottom than across a top thereof so that said device can be stacked inside of atop another such device, wherein said top surface is foldable relative to said side surfaces and has at least two side panels which are juxtaposed to respective side surfaces other than a side surface to which said top surface is attached when said top surface is in a closed position.

2. An advertising display device for mounting on a bottle of a type having a top, neck, shoulder and body, comprising:

a tube having a front, back and two flat side surfaces forming a rectangular cross-section, open at a bottom and having a closed top surface attached to said back side surface, said top surface having a central opening for permitting the passage therethrough of the bottle top and neck and a bottom of said side surfaces being shaped to provide four points for contacting the shoulder of said bottle, each of said side surfaces being wider across a bottom thereof than across a top thereof so that said device can be stacked inside or atop another such device.

3. A device according to claim 2, wherein said top surface is openable so that said device can be folded flat.

4. A device according to claim 3, including a front flap attached to a top of said front side surface, said flap having a slot adjacent a top edge of said front side surface and said top surface has a downwardly depending flap dimensioned to be insertable in said slot.

5. A device according to claim 2, wherein said top surface includes side wings extending upon alongside respective ones of said two side surfaces of said tube and a front flap joined along a top edge of said front side surface and extending to said top side wings so as to hold them against respective ones of said two side walls.

6. A device according to claim 2, wherein said top surface opening has a plurality of spaced apart radial cuts therein extending from a perimeter of said opening towards associated edges of said top surface.

7. A device according to claim 2, wherein said side surfaces each having an arcuate bottom edge.

* * * * *

UNITED STATES PATENT AND TRADEMARK OFFICE

CERTIFICATE OF CORRECTION

PATENT NO. : 5,289,650

DATED : March 1, 1994

INVENTOR(S) : Brian Follett et al.

It is certified that error appears in the above-indentified patent and that said Letters Patent is hereby corrected as shown below:

Tilte page, item [75], inventor: should read--Richard Heron--.

Column 1, line 11, delete "advertisier" and substitute therefor --advertiser--;

Column 1, line 12, delete "adapter" and substitute therefor --adapted--;

Column 2, line 37, delete "unction" and substitute therefor --conjunction--;

Column 4, line 7, after "stacked inside" delete "of" and substitute therefor --or--

Signed and Sealed this

Thirtieth Day of August, 1994

*Attest:*

*Attesting Officer*

BRUCE LEHMAN

*Commissioner of Patents and Trademarks*